US007614822B1

(12) United States Patent
Burritt et al.

(10) Patent No.: US 7,614,822 B1
(45) Date of Patent: Nov. 10, 2009

(54) FLUID DISTRIBUTION SYSTEM

(76) Inventors: Wayne Burritt, 78 Cross Hwy., Redding Center, CT (US) 06875; Robert Butler, 107 Black Rock Turnpike, Redding, CT (US) 06896; Frank A. Schaub, 319 Burton Rd., Beacon Falls, CT (US) 06403

( * ) Notice: Subject to any disclaimer, the term of this patent is extended or adjusted under 35 U.S.C. 154(b) by 210 days.

(21) Appl. No.: 11/805,915

(22) Filed: May 25, 2007

Related U.S. Application Data

(60) Provisional application No. 60/812,028, filed on Jun. 7, 2006.

(51) Int. Cl.
*E02B 11/00* (2006.01)
*E02B 15/00* (2006.01)

(52) U.S. Cl. ..... 405/43; 405/45; 405/50; 210/170.08

(58) Field of Classification Search ..... 405/36, 405/43, 45, 48, 50; 210/170.01, 170.03, 210/170.08; 52/169.5
See application file for complete search history.

(56) References Cited

U.S. PATENT DOCUMENTS

| | | | | |
|---|---|---|---|---|
| 4,880,333 | A * | 11/1989 | Glasser et al. | 405/43 |
| 5,015,123 | A | 5/1991 | Houck et al. | |
| 5,017,040 | A | 5/1991 | Mott | |
| 5,017,042 | A | 5/1991 | Minor et al. | |
| 5,051,028 | A | 9/1991 | Houck et al. | |
| 5,316,410 | A | 5/1994 | Blume | |
| 5,444,950 | A | 8/1995 | Kelly et al. | |
| 5,495,696 | A | 3/1996 | Repka | |
| D379,850 | S | 6/1997 | Nelson | |
| 5,823,711 | A | 10/1998 | Herd et al. | |
| 5,899,031 | A | 5/1999 | Nagaoka et al. | |
| 6,048,131 | A * | 4/2000 | Laak | 405/43 |
| 6,267,882 | B1 | 7/2001 | Houck et al. | |
| 6,315,493 | B2 | 11/2001 | Malone et al. | |
| 6,443,652 | B1 | 9/2002 | Houck et al. | |
| 6,854,924 | B2 | 2/2005 | Ring | |
| 6,991,408 | B2 | 1/2006 | Bottriell et al. | |
| 7,374,670 | B2 * | 5/2008 | Potts | 210/150 |
| 2006/0272988 | A1 | 12/2006 | Potts | |

* cited by examiner

*Primary Examiner*—David J Bagnell
*Assistant Examiner*—Benjamin Fiorello
(74) *Attorney, Agent, or Firm*—Melvin I. Stoltz

(57) ABSTRACT

By providing an easily transported, filler component system, leaching field forming elements for establishing a series of flexible design passageways into which the desired fill material is placed, a highly effective, easily installed, competitively priced with enhanced biological habitat underground fluid distribution system is achieved. In accordance with the present invention, the desired passageways are quickly and efficiently created by employing pre-folded cardboard panels, or other pervious materials, placing the materials in an excavated location or site in cooperating relationship with each other for creating the desired leaching fields. In the preferred embodiment, two, substantially identical, pre-folded cardboard panels are employed and are positioned in juxtaposed, cooperating, spaced, facing relationship with each other, establishing a central passageway therebetween.

17 Claims, 3 Drawing Sheets

FIG. 3
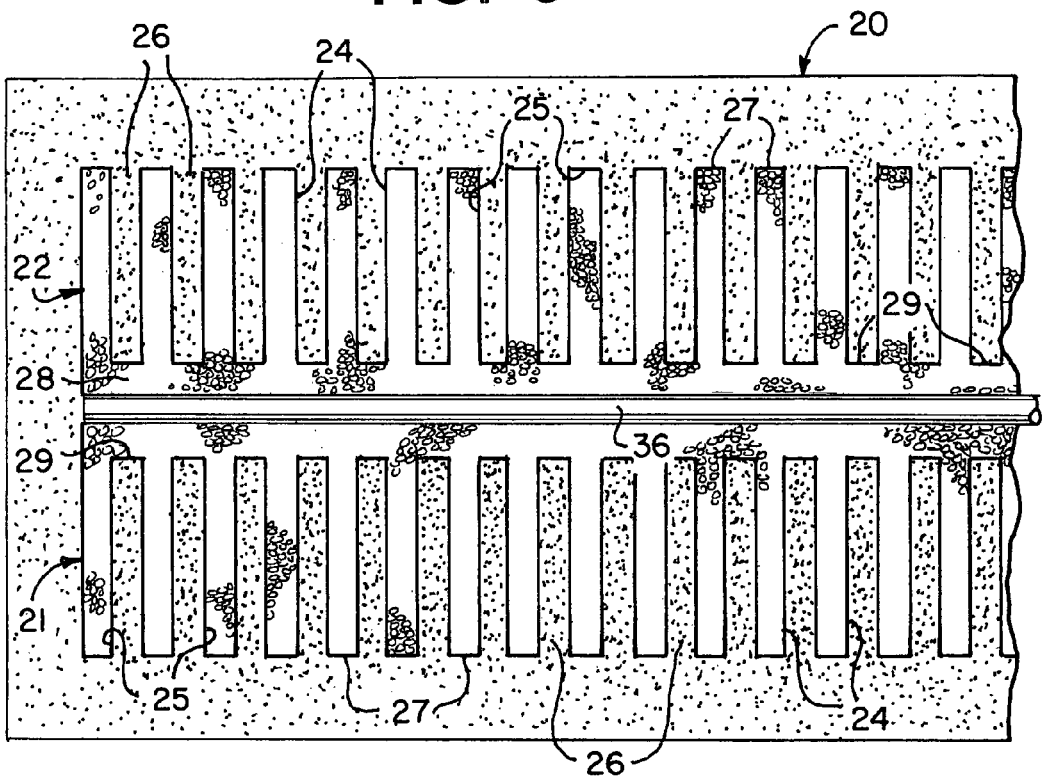
FIG. 4
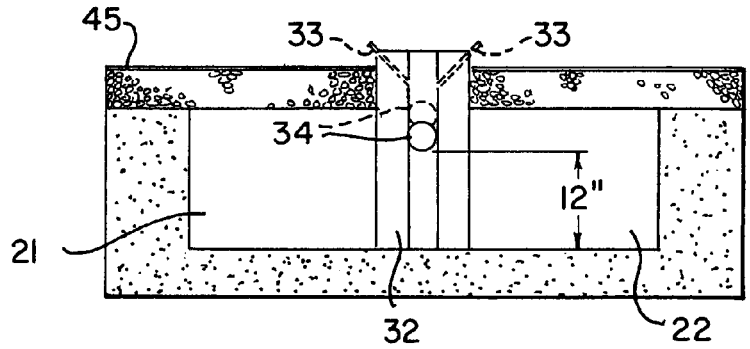
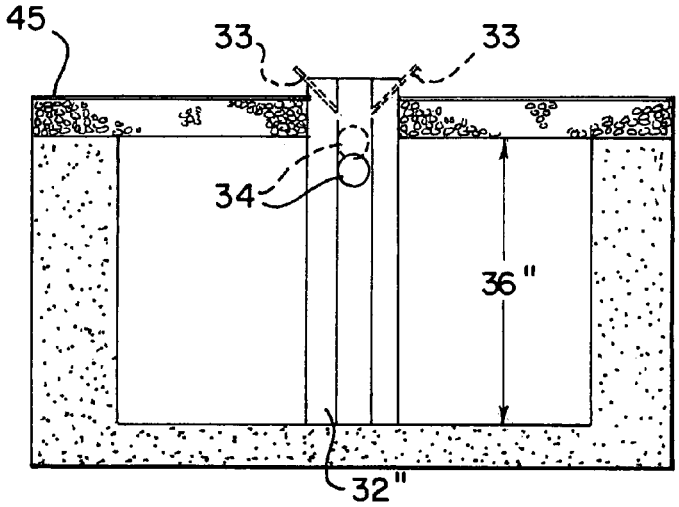
FIG. 5

FLUID DISTRIBUTION SYSTEM

RELATED DATA

This application is related to U.S. Provisional Patent Application Ser. No. 60/812,028, filed Jun. 7, 2006, entitled FLUID DISTRIBUTION SYSTEM.

TECHNICAL FIELD

This invention relates to underground fluid distribution systems and, more particularly to a system of component pieces assembled in underground fluid distribution systems which are compact, permitting installation in smaller areas than other systems and installed in a cost-effective manner and becoming environmentally friendly.

BACKGROUND ART

For many years, substantial attention has been devoted to the development of improved underground fluid distribution systems which are capable of effectively treating and handling water, sewage effluent, and other similar liquids in an efficient manner. In particular, the effective and efficient filtration of these liquids is required in a system which is capable of being installed easily, efficiently, and at a competitive price. In spite of the industry needs for improved underground fluid distribution systems, prior art systems have failed to provide highly effective, easily installed, efficient and competitively priced systems.

Septic systems or sewage disposal systems are well known as the primary method for treating and disposing of sewage in most locations where public sewage systems are unavailable. Typically, septic systems are designed to provide partial treatment of the sewage, with disposal into the soil in such a manner that the sewage stays underground and is further treated by soil organisms so that contaminants do not reach groundwater or streams. Such sewage systems typically comprise a septic tank and a leaching device or leaching field.

In this regard, the septic tank is a large holding tank designed to trap solids and grease and provide an initial, primary treatment of the sewage. The sewage flows by gravity to the leaching device or fields wherein the liquid sewage soaks into the soil and most of the treatment takes place, typically by biological processes. In order to control the flow of the sewage into the soil, the leaching device or leaching fields typically consists of a plurality of gravity filled trenches in combination with a perforated pipe which receives the effluent from the septic tank and delivers the effluent to the leaching fields.

In order to protect both the public and private drinking water supplies, governmental agencies have imposed stringent regulations on septic systems, in general, and the design and installation of new septic systems, in particular. As a result, substantial care and attention must be paid to the construction and installation of septic systems which includes specific regulations on the overall size and dimensions of the leaching fields being installed, based upon the soil conditions and the overall topography of the area in which the leaching field is being placed.

In view of new standards and governmental oversight in protecting rivers, streams, and groundwater supplies, consumers' cost for the installation of a new septic system, as well as the repair and/or reconditioning of existing septic systems has been increasing substantially. In addition, although substantial pressure has been imposed by consumers on more efficient systems and more efficient installation procedures, prior art constructions have failed to meet the consumer demand.

In particular, substantial costs and expenses are incurred in forming the plurality of trenches required for the leaching fields, constructing the trenches to the proper depth, and then filling the trenches with the required materials. Although some attempts have been made to develop systems that achieve leaching fields in a more efficient manner, these prior art attempts have failed to provide effective systems which are also cost efficient.

Therefore, it is a principal object of the present invention to provide an underground fluid distribution system which is comparatively easy to install in virtually any location, thereby providing a system which is low in cost and utilizes much less space.

Another object of the present invention is to provide an underground fluid distribution system having the characteristic features described above which is highly efficient and effective in providing complete absorption and dispersion of liquid discharged from a septic tank or sewage treatment system.

Another object of the present invention is to provide an underground fluid distribution system having the characteristic features described above which is capable of being installed in an extremely time efficient manner, with overall simplicity and ease.

Another object of the present invention is to provide an underground fluid distribution system having the characteristic features described above which employs only materials approved by state public health department and specially designed construction forms for assuring a high-quality installation product.

Another object of the present invention is to provide an underground fluid distribution system having the characteristic features described above which is installed in a small or compact area without any loss of overall efficacy than other existing systems.

Another object of the present invention is to provide preformed cardboard components, easily assembled in the field to form a custom system designed to meet many various demands of the site.

Another object of the present invention is to "kickstart" the working of the system by spraying an enzyme enriched solution directly to the cardboard. The bacteria attracted by the glucose in the cardboard quickly form an efficient biomat in the void, resulting in a very efficient cleaning action especially useful in waterside locations.

Other and more specific objects will in part be obvious and will in part appear hereinafter.

SUMMARY OF THE INVENTION

By employing the present invention, all of the difficulties and drawbacks found in the prior art have been overcome, and a highly effective, easily installed, competitively priced underground fluid distribution system is achieved. In accordance with the present invention, easily transported, prefabricated, leaching field forming elements are employed for establishing a series of passageways into which the desired fill material is placed. In this way, substantially reduced construction time is realized and an efficiently installed system is achieved.

In accordance with the present invention, the desired passageways are quickly and efficiently created by employing pre-folded cardboard panels, or other pervious form materials, placing the materials in an excavated location or site in cooperating relationship with each other for creating the desired leaching fields. In the preferred embodiment, two, substantially identical, pre-folded cardboard panels are employed and are positioned in juxtaposed, cooperating, spaced, facing relationship with each other.

In the preferred embodiment, each pre-folded cardboard panel or other form material is constructed in an elongated, substantially continuous manner and is placed in the excavated site in folded, zig-zag relationship with each other. In addition, pre-cut spacers or braces are mounted to the top edge of the panels to maintain the position of the pervious material.

In this way, a plurality of separate elongated channels are effectively established, with each channel comprising a curved, rectangular, or square shape and being substantially parallel to each other. In addition, with each of the pre-folded cardboard panels positioned in the excavated site in spaced relationship with each other, the elongated channels which are formed extend from one terminating edge of a first panel to the opposed terminating edge of the second panel. In addition, with the two folded panel members positioned in spaced relationship to each other, an elongated central channel or passageway is formed therebetween.

As it more fully detailed below, by employing the present invention, the typical, prior art, elongated gravel filled trenches, which are required to extend over a substantial area in order to obtain the necessary coverage, is virtually eliminated, and a compact, easily constructed, fully integrated trench construction is realized. As a result, the use of the present invention substantially reduces the area required by prior art systems.

In addition, in order to assure ease of use and rapid assembly of the underground fluid distribution system of the present invention, pre-cut spacers and/or braces are mounted to the top edges of the cardboard panels, effectively locking the panels in the desired position and establishing the desired distribution pattern and zones. Furthermore, enlarged, elongated, chute-forming plates are also mounted to the edges of the two cardboard panels on both sides of the central cavity formed between the two panel members. As is more fully detailed below, the chute-forming plates provide an effective sloping guide surface or funnel for enabling the stone, gravel and/or fill material to be quickly and easily added to the distribution system formed by the panel members. In this way, construction time is substantially reduced and expensive man-hours are effectively controlled.

In the preferred construction of the present invention, the cardboard panels, or other pervious material, which are placed in the excavated location for forming the plurality of elongated channels preferably comprises a pervious filter fabric material affixed to one surface thereof. In this way, an additional filtration barrier is formed as an integral component of the underground fluid distribution system for further enhancing the performance of the system when fully installed. Furthermore, the filter fabric material provides an environmentally stable platform for a biological mat to quickly form, providing added effluent treatment through the mat and the fabric.

When the two elongated cardboard panels are positioned in the excavated site in the manner detailed above, a plurality of rectangular channels are formed by each elongated cardboard panel member with the rectangular shaped channels formed by each cardboard panel being in cooperating, facing relationship with each other, along with an elongated central passageway formed, thereby forming a single line fluid distribution system not necessarily in a straight line but could be curved to suit a particular topography. In order to complete the construction of the channels and passageway, properly dimensioned gravel or stone is poured through the chute forming plates in order to fill the central passageway and rectangular channels formed by each cardboard panel member.

Finally, the opposed sides of each channel of each cardboard panel member, which remain open to the surrounding area of the excavated site, are filled with suitable porous sand as backfill material. In this way, the entire underground fluid distribution system of the present invention is a fully stabilized and is ready for final assembly.

Once the fluid distribution system of the present invention has been installed in place and the fill material added, as detailed above, the system is ready for accepting liquids discharged from a septic tank or sewage treatment system. Typically, an elongated, performed distribution pipe is placed near or at the top of the underground fluid distribution system along the central passageway thereof, for enabling the liquid effluent to be delivered to the underground fluid distribution system for absorption and dispersion into the soil through the central passageway and the elongated, rectangular shaped channels formed by the cardboard panels.

Typically, as the liquid effluent exits the perforated distribution pipe, the liquid drops vertically onto the impervious stone or gravel material which has been placed in the assembled distribution system of this invention, spreading from the central passageway through the elongated channels. Filtration of the liquid occurs as the liquid falls to the bottom of the structure or comes into contact with the soil specifically placed beneath the distribution system.

When fully installed, the fluid distribution system of the present invention provides a superior construction for filtration of liquids in a compact space for efficiently treating and dispersing the effluent material. A filter fabric barrier is preferably placed on the top of the assembled system to prevent soil used to cover the installation from entering the fill material place between the independent, interconnected external fabric covered sides thereof. In this way, a highly effective, fluid distribution system is realized and obtained in a cost effective manner.

As detailed above, the present invention provides a flexible system of interlocking corrugated cardboard panels of modular design which when assembled in the field to a state certified engineers or installer's design, based on the many variations of the site, provides a system that uses less space than other current products, provides a fast acting bio mat with high cleansing properties, is inexpensive, easy and quick to install, can overcome problems of difficult sites which includes but not limited to soil permeability, space available, shape of space available, environmental sensitivities, volume of effluent, or other state mandated situations.

The invention accordingly comprises an article of manufacture possessing the features, properties, and relation of elements which will be exemplified in the article hereinafter described, and the scope of the invention will be indicated in the claims.

THE DRAWINGS

For a fuller understanding of the nature and object of the invention, reference should be had for the following detailed description taken in connection with the accompanying drawings, in which:

FIG. 3 is a top plan view of a typical fluid distribution assembly of FIG. 2;

FIG. 4 is an end view of a typical fluid distribution system; and

FIG. 5 is an end view of an alternate embodiment of the fluid distribution system.

DETAILED DISCLOSURE

Figure 1:
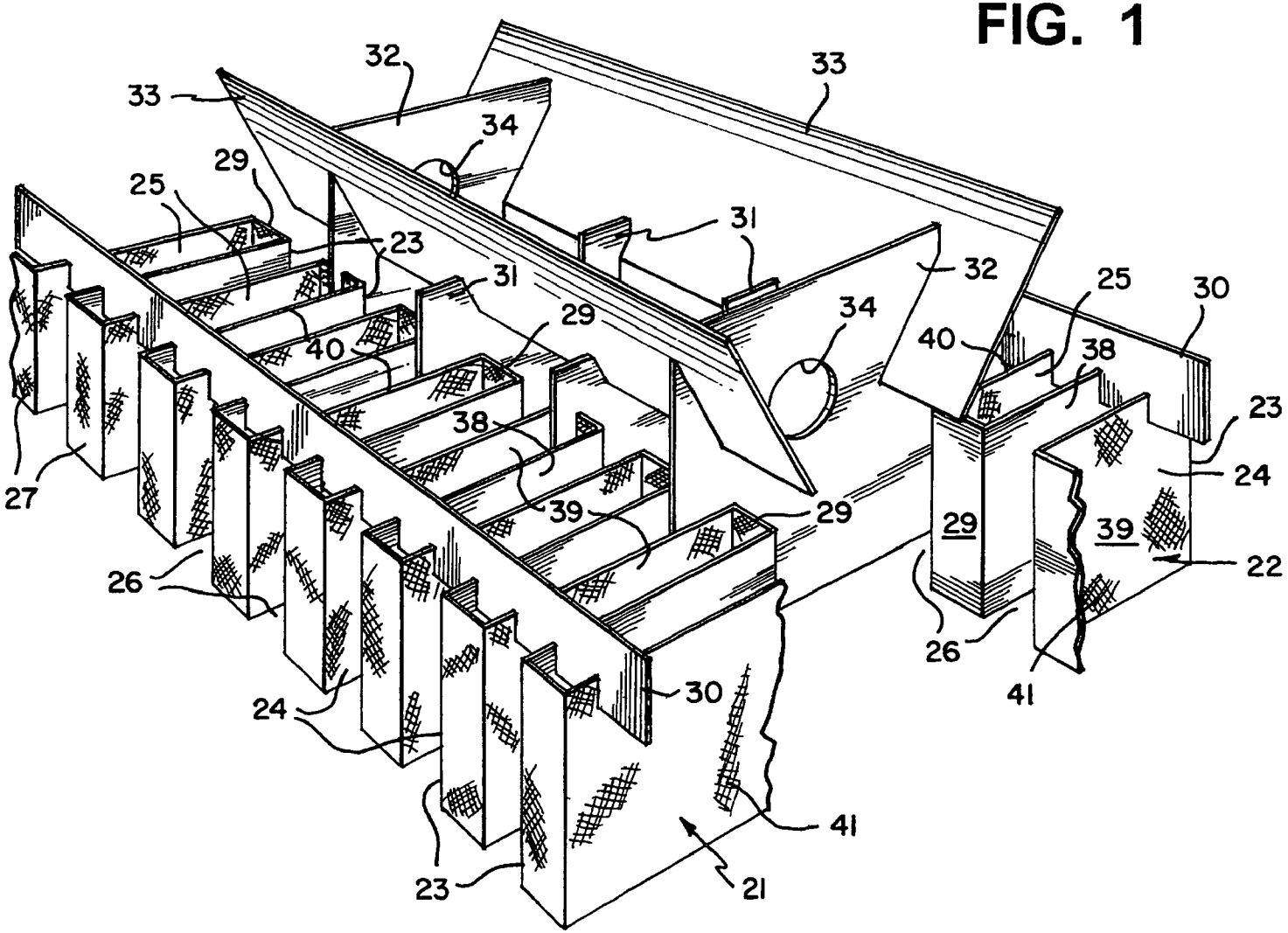
FIG. 1 is a perspective view of a typical fully assembled fluid distribution system of the present invention prior to the addition of any fill material.
Figure 2:
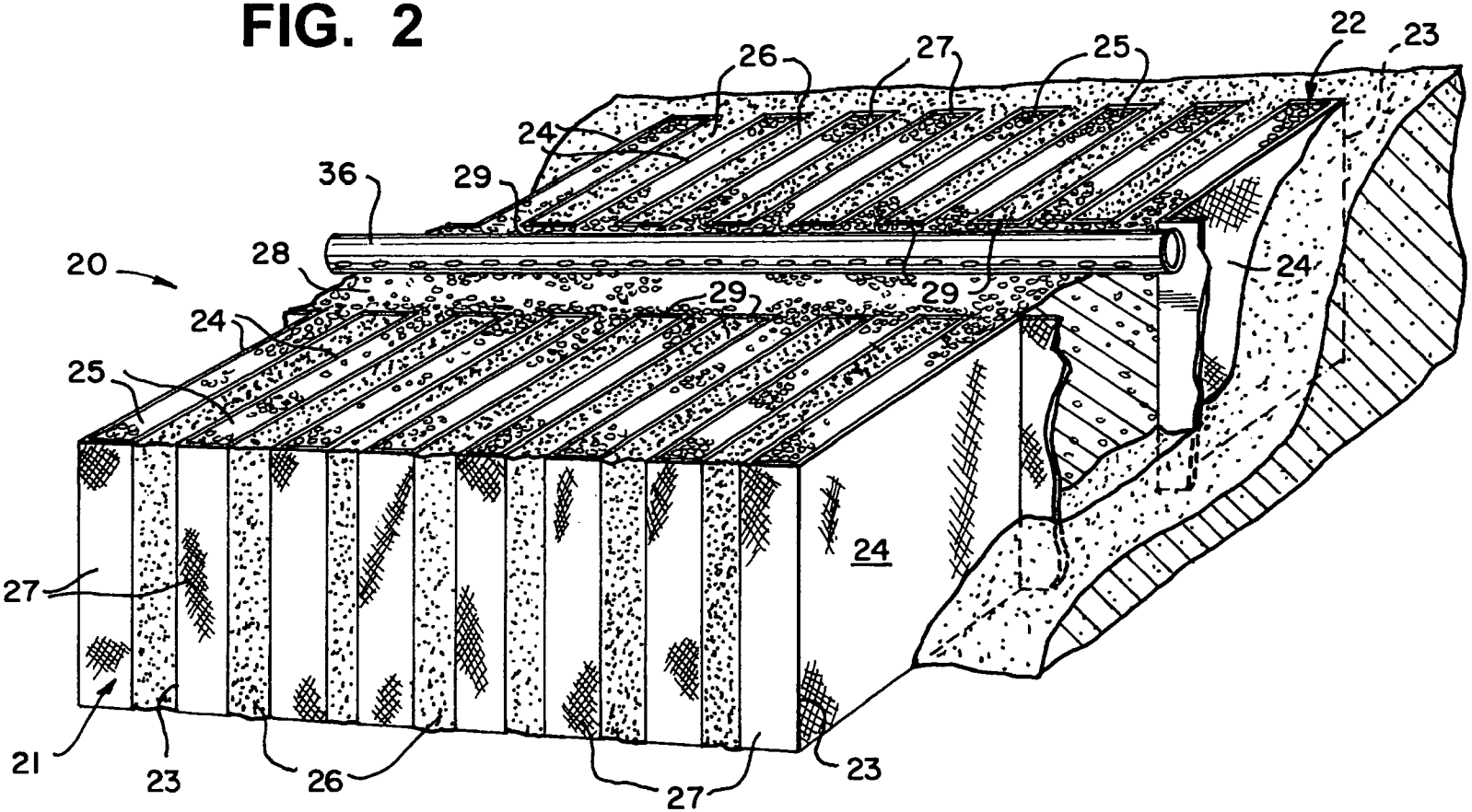
FIG. 2 is a perspective view of a typical distribution system of FIG. 1, fully assembled and ready for use.

By referring to FIGS. 1-5, along with the following detailed discussion, the preferred construction and operation of fluid distribution system 20 of the present invention can best be understood. However, it is also to be understood that alterations and variations can be made in the embodiment detailed herein without departing from the scope of the present invention. Consequently, the embodiment disclosed in FIGS. 1-4 and fully discussed below is provided for exemplary purposes only and is not intended as a limitation of the present invention. Although not shown, it is clearly envisaged that the assembled system can be a curved, straight, square, or a combination of all of these configurations.

As an overview, the present invention provides a flexible system of interlocking corrugated cardboard panels of modular design which when assembled in the field to a state certified engineers or installer's design, based on the many variations of the site, provides a system that uses less space than other current products, provides a fast acting bio mat with high cleansing properties, is inexpensive, easy and quick to install, can overcome problems of difficult sites which includes but not limited to soil permeability, space available, shape of space available, environmental sensitivities, volume of effluent, or other state mandated situations.

As shown in FIGS. 1-5, the preferred embodiment of fluid distribution system 20 of the present invention comprises two elongated, continuous, foldable panel members 21 and 22, each of which are constructed for being quickly and easily positioned in a desired pattern arrangement. As depicted, panel members 21 comprise a plurality of pre-formed fold lines 23 formed therein, positioned in parallel relationship to each other along the entire length of panel member 21. Similarly, panel member 22 is constructed in a substantially identical manner.

As depicted, panel members 21 and 22 effectively comprise, due to the construction and positioning of fold lines 23, a plurality of enlarged wall panels 24, each of which are adjacent to a plurality of side forming walls 27 and 29. As is more fully detailed below, enlarged wall panels 24 and sidewalls 27 and 29 may comprise any overall dimensions required for a particular installation. However, in general, sidewalls 27 and 29 are preferably formed with a width ranging between about 3 inches and 5 inches, with 4 inches being preferred.

Furthermore, enlarged wall panels 24 preferably have a width ranging between about 22 inches and 28 inches, with 25 inches being preferred. In addition, enlarged panels 24 may incorporate a vertical height which varies, depending upon the overall size of the leaching field being constructed. In general, it has been found that the overall vertical height of enlarged wall panels 24 preferably ranges between about 12 inches and 36 inches. Although these dimensions are preferred, any other dimensions desired may be employed with equal efficacy.

In the preferred embodiment, panel members 21 and 22 are positioned in a desired excavated location, or other acceptable area, which is to be employed for providing filtration of domestic sewage. Preferably, panel members 21 and 22 are quickly and easily formed into the desired configuration, and then placed in the desired location in juxtaposed, spaced, cooperating alignment with each other. In this regard, each panel member 21 and 22 is formed into a continuous, longitudinally extending, sinuous, zig-zag configuration, as detailed below, and positioned in longitudinally extending, spaced, cooperating relationship with each other, forming longitudinally extending, central corridor or passageway 28 therebetween.

In addition, in placing each elongated panel member 21 and 22 in the desired position for forming the fluid distribution system of the present invention, each panel member 21 and 22 is folded along fold lines 23 in order to effectively establish a first plurality of elongated, substantially rectangular shaped cavities or channels 25 which are open on one side and closed on the opposed side by sidewall 27. In addition, a second plurality of elongated, substantially rectangular shaped cavities or channels 26 are also formed which are open on one side while being closed on the opposed side by sidewall 29. As shown, elongated, substantially rectangular shaped cavity/channels 25 and 26 are each aligned in juxtaposed, spaced, parallel relationship to each other.

In this embodiment of the present invention, elongated panel members 21 and 22 each comprise an inside surface 38, and outside surface 39, and a top edge 40. In addition, outside surface 39 of panel members 21 and 22 is preferably coated substantially in its entirety with pervious filter fabric material 41. Although the use of pervious filter fabric material 41 on outside surface 39 of panel members 21 and 22 is preferred and is highly desirable, it is within the scope of the present invention to construct fluid distribution system 20 without employing pervious filter fabric material 41.

In order to enable fluid distribution system 20 of the present invention to be quickly and easily arranged in the precisely desired configuration for use, system 20 incorporates, in addition to panel members 21 and 22, bracing members 30, 31, 32, and 33, each of which are configured for locking interengagement with top edge 40 of panel members 21 and 22 for establishing and maintaining the desired overall system configuration. In this regard, by referring to FIG. 1, along with the following discussion, the construction and positioning of these bracing members can best be understood.

In a typical embodiment, a pair of cavity/channel bracing members 30 are mounted on top edge 40 of panel members 21 and 22 effectively establishing the position and dimensions for cavities/channels 25 and 26 of panel members 21 and 22. In the preferred embodiment, cavity bracing members 30 comprise an elongated strip of material, preferably cardboard, which has been pre-cut to quickly and easily be locked in the desired position along top edge 40 of panel members 21 and 22. In this way, by forming the slots in cavity bracing member 30 at the precisely desired locations, the precisely desired width of cavities 25 and 26 are automatically established and maintained.

In addition, central bracing members 31 and end wall bracing members 32 are constructed for being mounted to top edge 40 of panel members 21 and 22 in a plurality of locations in which portions of panel members 21 and 22 are placed in juxtaposed spaced relationship. By employing central bracing members 31 and end wall bracing members 32, the precisely desired spaced distance between panel members 21 and 22 is quickly and easily established. In addition, the spacing created between panel members 21 and 22 also establishes and maintains the desired spaced distance for forming central corridor or passageway 28 between panel members 21 and 22, through which the desired water, sewage effluent, or other liquid is delivered and is capable of passage therethrough.

In the preferred construction, central bracing members 31 are precut for mounting top edge 40 of panel members 21 and 22 and extend downwardly from the top edge 40 of panel members 21 and 22 a distance substantially equivalent to cavity bracing member 30. However, in the preferred construction, end wall bracing members 32 are substantially larger than central bracing members 31, extending downwardly to the bottom edge of panel members 21 and 22, while also extending a substantial distance above the top edge of panel members 21 and 22. In addition, end wall bracing members 32 also preferably incorporate an enlarged circular aperture 34 formed therein which is employed for enabling the apertured, effluent conducting and distributing pipe 36 to be easily inserted therethrough for being placed in the precisely desired position and location.

Finally, in the preferred embodiment, fill control bracing plates or members 33 are mounted to fluid distribution system 20 in a slanted or sloping position, preferably by engaging fill control bracing members 33 along the top edge 40 of end wall bracing members 32. Although the use of sloping fill control bracing members 33 is optional, the use of fill control bracing members 33 is preferred for enabling the desired material inserted into fluid distribution system 20 of the present invention to be directed to the precisely desired locations in a highly efficient and effective manner.

In this regard, in order to provide an effective and efficient underground fluid distribution system 20, the proper fill material must be employed. It has been found that clean stone having a dimension ranging between about ½" and 1 inch, with ¾" being preferred, is employed. Preferably, the clean stone is poured through chute forming plates 33 and carefully distributed throughout passageway 28 and elongated, longitudinally extending cavities or channels 25.

In this regard, it has been found that the stone fill material is preferably slowly dumped through chute forming plates/members 33 and manually spread throughout passageway 28 and cavities/channels 25. In addition, the filling process preferably continues until fluid distribution system 20 has been partially filled with the stone fill material. Although the quantity of stone fill material which should be placed in passageway 28 and cavities/channels 25 may vary depending upon desired construction situations, it has been found that fluid distribution system 20 should be initially filled to a level ranging between about one-half (½) to about three-quarters (¾) of the desired height.

Once the desired partial fill level has been reached, the back fill material is placed in cavities/channels 26, thereby bracing large wall panels 24 of elongated panel members 21 and 22 in order to assure that panel members 21 and 22 are maintained in a precisely desired position and spaced orientation. In the preferred embodiment, sand fill is employed for filling rectangular shaped cavity/channels 26 as well as for peripherally surrounding the entire fluid distribution system 20, once complete assembly has been realized. In this regard, any type of porous sand backfill material typically employed for sewage treatment systems can be employed. Similarly, the stone fill material employed in corridor 28 and cavities/channels 25 may also comprise a stone or gravel typically employed in this industry. In addition, alternate impervious fill materials may be employed, such as peastone, rubber tire chips, and other similar material capable of providing voids and liquid storage.

Once cavities/channels 26 have been filled with the desired sand backfill material to a level substantially equivalent to the level of the stone in cavities/channels 25, and the sand material has been compacted, the assembly of fluid distribution system 20 is completed. First, passageway 28 and channels/cavities 25 are filled to the desired level with the pre-selected stone material. Thereafter, perforated or apertured elongated distribution pipe 36 is positioned longitudinally extending the entire length of passageway 28, assuring the delivery of the liquid effluent to fluid distribution system 20 in the desired manner. In this regard, the perforations or apertures formed in elongated distribution pipe 36 are preferably positioned downwardly, facing the stone fill material in order to assure the most efficient delivery of the liquid to fluid distribution system 20.

Thereafter, distribution pipe 36 is covered with 2 inches of the stone material and elongated cavities/channels 26 are completely filled with the sand backfill and compacted. In order to complete the entire assembly, all of the stone and sand are filled to the specific desired height followed by the removal of the cardboard stone placement chutes and other cardboard bracing elements. The entire areas is covered with approved materials, in the required manner, and distribution pipe 36 is connected to the desired source.

By employing these components in the manner detailed above, an easily constructed, effective, and efficient fluid distribution system 20 is attained. Furthermore, in addition to providing a cost efficient and highly effective fluid distribution system, the present invention also achieves a system which is capable of being completely assembled quickly and easily, along with the requisite filling materials being inserted therein. Once completed, fluid distribution system 20 is ready for immediate use.

In accordance with the present invention, elongated, foldable, panel members 21 and 22 are preferably formed from cardboard with the desired filter fabric material 41 placed on outside surface 39 covering outside surface 39 substantially in its entirety. In this regard, it has been found that the cardboard material may comprise a thickness ranging between about ⅛ inches and ¾ inches. Preferably, however, single wall cardboard having a thickness of ¼ inch or double wall cardboard, having a thickness of about ½ inch, are preferred. Furthermore, corrugated cardboard is preferably employed, although corrugated cardboard is not required. In addition, if desired, the filter fabric material can be eliminated and not used at all.

It has also been found that other pervious hard materials can be employed to create a similarly shaped, compact, intricate fluid distribution system 20, in accordance with this invention. In this regard, the panel members forming fluid distribution system 20 may be constructed of other pervious hard materials preformed to create a similar shaped intricate product.

In the case of pervious materials, such as wood, fabric, and the like, the materials may be left in place as detailed above with the use of cardboard. Application of an enzyme solution to the cardboard surfaces of the assembled form provide rapid deterioration of the pervious materials.

As discussed above, pervious filter fabric material 41 is preferably employed and is formed on the outside or external surfaces of panel members 21 and 22. In this way, independent external leaching sides are established, along with the establishment of central corridor 28 along with a plurality of radiating fingers, cavities or channels 25 and 26 perpendicularly extending from central corridor 28.

The fluid distribution system 20 of the present invention works by accepting liquid applied to the system through the perforated distribution pipe 36 placed through apertures 34 of end wall bracing members 32. The liquid exits the distribution pipe, dropping vertically onto the pervious backfill material placed within the assembled cardboard structure. Aeration of the liquid occurs as the liquid falls to the bottom of the structure where the liquid contacts the sand or soil specifically placed beneath fluid distribution system 20 of the present invention. The liquid is filtered by the sand before contacting native soil.

Whenever the internal bottom area of the fluid distribution system becomes clogged or otherwise limits the flow of liquid, the liquid level will rise within fluid distribution system 20, contacting the cardboard surfaces and causing the cardboard to disintegrate as it is now wetted and biodegrades. The end result is the creation of a vertical fabric wrapped perimeter or envelope which now provides additional filtering of liquids through the fabric, with the secondary sand and backfill filter also treating the liquid before it reaches native soil.

Furthermore, the specifically designed fingers, cavities or channels 25 and 26 formed by panel members 21 and 22 increase the application area for any given length of product assembly as installed in the ground, or within a specified placement area of specified fill material. In this way, a superior method for application of liquids in compact spaces is achieved, which is efficient in treating and dispersing the effluent. Preferably, a pervious barrier layer 45 is placed on top of the entire assembly to prevent soil used to cover the installation from entering the pervious backfill material placed between the panel members forming the distribution system of this invention.

It will thus be seen that the objects set forth above, among those made apparent from the preceding description, are efficiently attained and, since certain changes may be made in the above article without departing from the scope of the invention, it is intended that all matter contained in the above description or shown in the accompanying drawing shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Having described our invention, what we claim as new and desire to secure by Letters Patent is:

1. A system for constructing an underground fluid distribution assembly which is constructed for receiving effluent liquid from a septic tank or sewage system and absorbing and distributing the liquid to soil surrounding the system, said system comprising:

A. a first, elongated, continuous, substantially flat, prefolded, multi-panel forming sheet of material comprising a. a first, elongated wall member comprising a substantially flat panel incorporating a top edge, a bottom edge, a first side edge, and a second side edge, b. a second, elongated wall member comprising a substantially flat panel incorporating a top edge, a bottom edge, a third side edge, and a fourth side edge, and positioned in juxtaposed, facing, spaced relationship to the first elongated wall member, with the first side edge of the first wall member being aligned with the fourth side edge of the second wall member while the second side edge of the first wall member is aligned with the third side edge of the second wall member, c. a third elongated wall member comprising a substantially flat panel incorporating a top edge, a bottom edge, a fifth side edge, and a sixth side edge, and positioned in juxtaposed, facing, spaced relationship to the second elongated wall member, with the fifth side edge of the third wall member being aligned with the fourth side edge of the second wall member while the sixth side edge of the third wall member is aligned with the third side edge of the second wall member, d. a fourth elongated wall member comprising a substantially flat panel incorporating a top edge, a bottom edge, a seventh side edge, and an eighth side edge, and positioned in juxtaposed, facing, spaced relationship to the third elongated wall member, with the seventh side edge of the fourth wall member being aligned with the sixth side edge of the third wall member while the eighth side edge of the fourth wall member is aligned with the fifth side edge of the third wall member, e. a fifth elongated wall member comprising a substantially flat panel incorporating a top edge, a bottom edge, a ninth side edge, and a tenth side edge, and positioned in juxtaposed, facing, spaced relationship to the fourth elongated wall member, with the ninth side edge of the fifth wall member being aligned with the eighth side edge of the fourth wall member while the tenth side edge of the fifth wall member is aligned with the seventh side edge of the fourth wall member, f. a first, smaller, interconnecting wall element extending between and interconnecting the second side edge of the first elongated wall member with the third side edge of the second elongated wall member, effectively establishing a first channel having a proximal terminating end wall formed by said first smaller interconnecting wall element, g. a second, smaller, interconnecting wall element extending between and interconnecting the fourth side edge of the second elongated wall member with the fifth side edge of the third elongated wall member, effectively establishing a second channel having a distal terminating end wall formed by said second smaller interconnecting wall element, h. a third, smaller interconnecting wall element extending between and interconnecting the sixth side edge of the third elongated wall member with the seventh side edge of the fourth elongated wall member, effectively establishing a third channel having a proximal terminating end wall formed by said third smaller interconnecting wall element, i. a fourth, smaller interconnecting wall element extending between and interconnecting the eighth side edge of the fourth elongated wall member with the ninth side edge of the fifth elongated wall member, effectively establishing a fourth channel having a distal terminating end wall formed by said fourth smaller interconnecting wall element;

B. a second, elongated, continuous, substantially flat, prefolded, multi-panel forming sheet of material comprising a. a first elongated wall member comprising a substantially flat panel incorporating a top edge, a bottom edge, a first side edge, and a second side edge, b. a second elongated wall member comprising a substantially flat panel incorporating a top edge, a bottom edge, a third side edge, and a fourth side edge, and positioned in juxtaposed, facing, spaced relationship to the first elongated wall member, with the first side edge of the first wall member being aligned with the fourth side edge of the second wall member while the second side edge of the first wall member is aligned with the third side edge of the second wall member, c. a third elongated wall member comprising a substantially flat panel incorporating a top edge, a bottom edge, a fifth side edge, and a sixth side edge, and positioned in juxtaposed, facing, spaced relationship to the second elongated wall member, with the fifth side edge of the third wall member being aligned with the fourth side edge of the second wall member while the sixth side edge of the third wall member is aligned with the third side edge of the second wall member, d. a fourth elongated wall member comprising a substantially flat panel incorporating a top edge, a bottom edge, a seventh side edge, and an eighth side edge, and positioned in juxtaposed, facing, spaced relationship to the third elongated wall member, with the seventh side edge of the fourth wall member being aligned with the sixth side edge of the third wall member while the eighth side edge of the fourth wall member is aligned with the fifth side edge of the third wall member, e. a fifth elongated wall member comprising a substantially flat panel incorporating a top edge, a bottom edge, a ninth side edge, and a tenth side edge, and positioned in juxtaposed, facing, spaced relationship to the fourth elongated wall member, with the ninth side edge of the fifth wall member being aligned with the eighth side edge of the fourth wall member while the tenth side edge of the fifth wall member is aligned with the seventh side edge of the fourth wall member, f. a first, smaller, interconnecting wall element extending between and interconnecting the second side edge of the first elongated wall member with the third side edge of the second elongated wall member, effectively establishing a first channel having a proximal terminating end wall formed by said first smaller interconnecting wall element, g. a second, smaller, interconnecting wall element extending between and interconnecting the fourth side edge of the second elongated wall member with the fifth side edge of the third elongated wall member, effectively establishing a second channel having a distal terminating end wall formed by said second smaller interconnecting wall element, h. a third, smaller interconnecting wall element extending between and interconnecting the sixth side edge of the third elongated wall member with the seventh side edge of the fourth elongated wall member, effectively establishing a third channel having a proximal terminating end wall formed by said third smaller interconnecting wall element, i. a fourth, smaller interconnecting wall element extending between and interconnecting the eighth side edge of the fourth elongated wall member with the ninth side edge of the fifth elongated wall member, effectively establishing a fourth channel having a distal terminating end wall formed by said fourth smaller interconnecting wall element;

C. said first elongated, continuous, substantially flat, pre-folded, multi-panel forming sheet of material being mounted in position longitudinally extending in juxtaposed, spaced relationship with the second, elongated, continuous, substantially flat, pre-folded, multi-panel forming sheet of material forming therebetween an elongated, substantially continuous, corridor or passageway;

D. said second channel of said first elongated, substantially continuous, substantially flat, pre-folded, multi-panel forming sheet of material being aligned with said second channel of said second elongated, substantially continuous, substantially flat, pre-folded, multi-panel forming sheet of material, with both of said second channels being open to and communicating with the elongated, substantially continuous, corridor or passageway;

E. said fourth channel of said first elongated, substantially continuous, substantially flat, pre-folded, multi-panel forming a sheet of material being aligned with said fourth channel of said second elongated, substantially continuous, substantially flat, pre-folded, multi-panel forming sheet of material, with both of said fourth channels being open to and communicating with the elongated, substantially continuous, corridor or passageway;

F. granular fill material positioned in and substantially filling said elongated corridor/passageway, both of said second channels and both of said fourth channels for providing a filtration system therein; and G. sand fill material positioned in and substantially filling the first channel and the third channel of said first elongated, substantially continuous, substantially flat, pre-folded, multi-panel forming sheet of material and said first channel and said third channel of said elongated, substantially continuous, substantially flat, pre-folded, multi-panel forming sheet of material, providing filtration means for receiving and absorbing liquid passing through said wall members from said granular material to said sand material.

2. The system for constructing an underground fluid distribution assembly defined in claim 1, wherein said elongated corridor or passageway is further defined as comprising a width ranging between about 10 inches and 15 inches.

3. The system for constructing an underground fluid distribution assembly defined in claim 1, wherein said system further comprises bracing means cooperatively associated with the top edges of the first and second elongated, pre-folded, multi-panel forming sheets of material for bracing said sheets and maintaining the sheets in the desired configuration.

4. The system for constructing an underground fluid distribution assembly defined in claim 1, wherein each of the channel members of each of the elongated, pre-folded, multi-panel forming sheets is further defined as comprising a length of about 2 feet, a height ranging between about 1 foot and 3 feet, and a width ranging between 3 inches and 5 inches.

5. The system for constructing an underground fluid distribution assembly defined in claim 1, wherein said system further comprises a sheet of filter fabric material covering substantially the entire surface of both elongated, pre-folded, multi-panel forming sheets of material with said sheet of filter fabric material being positioned on the surface thereof establishing the first and third channel members thereof.

6. The system for constructing an underground fluid distribution assembly defined in claim 1, wherein said system further comprises an elongated fluid distribution conduit longitudinally extending along the entire length of the central corridor or passageway, with said conduit being connected to a sewage treatment system or septic tank for receiving effluent liquid therefrom and delivering said liquid to the central corridor/passageway for distribution throughout the corridor and the second and fourth channel members of the first and second elongated, continuous, pre-folded, multi-panel forming sheets of material.

7. The system for constructing an underground fluid distribution assembly defined in claim 6, wherein said system further comprises sand fill material peripherally surrounding the entire underground fluid distribution system, with said sand fill material extending to the surrounding soil.

8. The system for constructing an underground fluid distribution assembly defined in claim 1, wherein said first and second elongated, pre-folded, multi-panel forming sheets of material are further defined as comprising pervious material.

9. The system for constructing an underground fluid distribution assembly defined in claim 8, wherein said pervious material is further defined as comprising one selected from the group consisting of cardboard, wood, and paperboard.

10. The system for constructing an underground fluid distribution assembly defined in claim 1, wherein said first and second elongated, pre-folded, multi-panel forming sheets of material is further defined as comprising cardboard having a thickness ranging between about ¼ inches and ¾ inches.

11. The system for constructing an underground fluid distribution assembly defined in claim 1, wherein the granular fill material positioned in and substantially filling said elongated corridor/passageway and said first and third channel members of the first and second elongated, continuous, pre-folded, multi-panel forming sheets of material is further defined as comprising stone having a diameter ranging between about ½ inches and 1 inch.

12. The system for constructing an underground fluid distribution assembly defined in claim 1, wherein each of the wall members of each of the elongated, pre-folded, multi-panel forming sheets of material are further defined as being positioned substantially parallel to each other.

13. A method for creating an underground fluid distribution system comprising the steps of:

A. excavating a location for enabling the placement of an underground distribution system therein;

B. positioning a first, elongated, continuous, substantially flat, pre-folded, multi-panel forming sheet of material in the excavated location for establishing a. a first, elongated wall member comprising a substantially flat panel incorporating a top edge, a bottom edge, a first side edge, and a second side edge, b. a second, elongated wall member comprising a substantially flat panel incorporating a top edge, a bottom edge, a third side edge, and a fourth side edge, and positioned in juxtaposed, facing, spaced relationship to the first elongated wall member, with the first side edge of the first wall member being aligned with the fourth side edge of the second wall member while the second side edge of the first wall member is aligned with the third side edge of the second wall member, c. a third elongated wall member comprising a substantially flat panel incorporating a top edge, a bottom edge, a fifth side edge, and a sixth side edge, and positioned in juxtaposed, facing, spaced relationship to the second elongated wall member, with the fifth side edge of the third wall member being aligned with the fourth side edge of the second wall member while the sixth side edge of the third wall member is aligned with the third side edge of the second wall member, d. a fourth elongated wall member comprising a substantially flat panel incorporating a top edge, a bottom edge, a seventh side edge, and an eighth side edge, and positioned in juxtaposed, facing, spaced relationship to the third elongated wall member, with the seventh side edge of the fourth wall member being aligned with the sixth side edge of the third wall member while the eighth side edge of the fourth wall member is aligned with the fifth side edge of the third wall member, e. a fifth elongated wall member comprising a substantially flat panel incorporating a top edge, a bottom edge, a ninth side edge, and a tenth side edge, and positioned in juxtaposed, facing, spaced relationship to the fourth elongated wall member, with the ninth side edge of the fifth wall member being aligned with the eighth side edge of the fourth wall member while the tenth side edge of the fifth wall member is aligned with the seventh side edge of the fourth wall member, f. a first, smaller, interconnecting wall element extending between and interconnecting the second side edge of the first elongated wall member with the third side edge of the second elongated wall member, effectively establishing a first channel having a proximal terminating end wall formed by said first smaller interconnecting wall element, g. a second, smaller, interconnecting wall element extending between and interconnecting the fourth side edge of the second elongated wall member with the fifth side edge of the third elongated wall member, effectively establishing a second channel having a distal terminating end wall formed by said second smaller interconnecting wall element, h. a third, smaller interconnecting wall element extending between and interconnecting the sixth side edge of the third elongated wall member with the seventh side edge of the fourth elongated wall member, effectively establishing a third channel having a proximal terminating end wall formed by said third smaller interconnecting wall element, i. a fourth, smaller interconnecting wall element extending between and interconnecting the eighth side edge of the fourth elongated wall member with the ninth side edge of the fifth elongated wall member, effectively establishing a fourth channel having a distal terminating end wall formed by said fourth smaller interconnecting wall element;

C. positioning a second, elongated, continuous, substantially flat, pre-folded, multi-panel forming sheet of material in the excavated location in juxtaposed, spaced, cooperating relationship with the first elongated, multi-panel forming sheet of material for establishing a. a plurality of first elongated wall member comprising a substantially flat panel incorporating a top edge, a bottom edge, a first side edge, and a second side edge, b. a second elongated wall member comprising a substantially flat panel incorporating a top edge, a bottom edge, a third side edge, and a fourth side edge, and positioned in juxtaposed, facing, spaced relationship to the first elongated wall member, with the first side edge of the first wall member being aligned with the fourth side edge of the second wall member while the second side edge of the first wall member is aligned with the third side edge of the second wall member, c. a third elongated wall member comprising a substantially flat panel incorporating a top edge, a bottom edge, a fifth side edge, and a sixth side edge, and positioned in juxtaposed, facing, spaced relationship to the second elongated wall member, with the fifth side edge of the third wall member being aligned with the fourth side edge of the second wall member while the sixth side edge of the third wall member is aligned with the third side edge of the second wall member, d. a fourth elongated wall member comprising a substantially flat panel incorporating a top edge, a bottom edge, a seventh side edge, and an eighth side edge, and positioned in juxtaposed, facing, spaced relationship to the third elongated wall member, with the seventh side edge of the fourth wall member being aligned with the sixth side edge of the third wall member while the eighth side edge of the fourth wall member is aligned with the fifth side edge of the third wall member, e. a fifth elongated wall member comprising a substantially flat panel incorporating a top edge, a bottom edge, a ninth side edge, and a tenth side edge, and positioned in juxtaposed, facing, spaced relationship to the fourth elongated wall member, with the ninth side edge of the fifth wall member being aligned with the eighth side edge of the fourth wall member while the tenth side edge of the fifth wall member is aligned with the seventh side edge of the fourth wall member, f. a first, smaller, interconnecting wall element extending between and interconnecting the second side edge of the first elongated wall member with the third side edge of the second elongated wall member, effectively establishing a first channel having a proximal terminating end wall formed by said first smaller interconnecting wall element, g. a second, smaller, interconnecting wall element extending between and interconnecting the fourth side edge of the second elongated wall member with the fifth side edge of the third elongated wall member, effectively establishing a second channel having a distal terminating end wall formed by said second smaller interconnecting wall element, h. a third, smaller interconnecting wall element extending between and interconnecting the sixth side edge of the third elongated wall member with the seventh side edge of the fourth elongated wall member, effectively establishing a third channel having a proximal terminating end wall formed by said third smaller interconnecting wall element, i. a fourth, smaller interconnecting wall element extending between and interconnecting the eighth side edge of the fourth elongated wall member with the ninth side edge of the fifth elongated wall member, effectively establishing a fourth channel having a distal terminating end wall formed by said fourth smaller interconnecting wall element;

D. establishing a central corridor or passageway in the spaced zone extending between the first, elongated, pre-folded, multi-panel forming sheet of material and the second, elongated, pre-folded, multi-panel forming sheet of material;

E. filling the central corridor/passageway and the second and fourth channel members of the first and second elongated, multi-panel forming sheets of material with gravel material;

F. filling the first and third channel members of the first and second elongated, multi-panel forming sheets of material with sand fill material;

G. positioning a fluid delivery conduit along the entire length of the central corridor/passageway with said conduit being connected to a septic tank or sewage treatment system for receiving effluent liquid therefrom and delivering said effluent liquid to the granular material of the central corridor/passageway;

whereby an underground fluid distribution system is achieved which is capable of receiving and filtering the affluent material.

14. The method for creating an underground fluid distribution system defined in claim 13, comprising the additional step of:

H. positioning bracing elements along the top edge of the first and second elongated, pre-folded, multi-panel forming sheets of material for establishing a desired spaced distance between the plurality of channel members and maintaining said channel members with the desired spacing and position.

15. The method for creating an underground fluid distribution system defined in claim 14, comprising the additional step of:

I. positioning an enlarged, elongated panel member along the top edge of the first and second elongated, pre-folded, multi-panel forming sheet of material directly adjacent the central corridor or passageway with said panel member having a slanted or sloping angle relative thereto for guiding the granular fill material into the desired locations of the central corridor/passageway and the second and fourth channel members thereof.

16. The method for creating an underground fluid distribution system defined in claim 13, wherein the central corridor/passageway and the first and third channel members of the first and second elongated, multi-panel forming sheets of material are filled to a level substantially equivalent to ¾ of the entire desired height followed by the filling of the second and fourth channel members of the first and second elongated, multi-panel forming sheets of material to substantially the same height.

17. The method for creating an underground fluid distribution system defined in claim 16, wherein both the central corridor/passageway and the first and third channel members of the first and second elongated, multi-panel forming sheets of materials are completely filled to their desired height, followed by the filling of the second and fourth channel members of the first and second elongated, multi-panel forming sheets of material to the desired height.

* * * * *